US012140061B1

(12) United States Patent
Vollmer et al.

(10) Patent No.: US 12,140,061 B1
(45) Date of Patent: Nov. 12, 2024

(54) EXHAUST GAS SYSTEM UNIT

(71) Applicant: TENNECO GMBH, Edenkoben (DE)

(72) Inventors: Sascha Vollmer, Edenkoben (DE); Andreas Lang, Edenkoben (DE); Daniel Trzebinski, Edenkoben (DE); Wladimir Rikow, Edenkoben (DE); Aaron Manley, Edenkoben (DE)

(73) Assignee: Tenneco GmbH, Edenkoben (DE)

( * ) Notice: Subject to any disclaimer, the term of this patent is extended or adjusted under 35 U.S.C. 154(b) by 0 days.

(21) Appl. No.: 18/291,090

(22) PCT Filed: Jul. 22, 2022

(86) PCT No.: PCT/EP2022/070629
§ 371 (c)(1),
(2) Date: Jan. 22, 2024

(87) PCT Pub. No.: WO2023/002019
PCT Pub. Date: Jan. 26, 2023

(30) Foreign Application Priority Data

Jul. 23, 2021 (DE) ..... 10 2021 119 169.6

(51) Int. Cl.
*F01N 3/20* (2006.01)
*F01N 3/029* (2006.01)
(Continued)

(52) U.S. Cl.
CPC ..... *F01N 3/2006* (2013.01); *F01N 3/24* (2013.01); *F01N 9/00* (2013.01); *F01N 3/0293* (2013.01);
(Continued)

(58) Field of Classification Search
CPC . F01N 3/2006; F01N 3/24; F01N 9/00; F01N 3/0293; F01N 3/0296;
(Continued)

(56) References Cited

U.S. PATENT DOCUMENTS 5,417,059 A 5/1995 Hartel et al.
5,459,998 A 10/1995 Hosoya et al.
(Continued)

FOREIGN PATENT DOCUMENTS

DE 3919343 A1 12/1990
DE 4307737 A1 9/1993
(Continued)

OTHER PUBLICATIONS

Machine Translation of DE 10345986 A1 (Year: 2005).*
(Continued)

*Primary Examiner* — Brandon D Lee
(74) *Attorney, Agent, or Firm* — Harness, Dickey & Pierce, P.L.C.

(57) ABSTRACT

The disclosure relates to an exhaust gas sub-system for an internal combustion engine, having a catalytic converter with an inlet section for introducing an exhaust gas flow into the outer housing and having a feed line for secondary gas, the feed line having an inflow element at the end, which opens at the inlet section, the outer housing has an inlet opening for exhaust gas, an external heating element for heating the secondary gas and for generating hot gas being provided in the feed line upstream of the inflow element, at least one inflow opening in the outer housing being assigned to the inflow element, via which hot gas can be fed into the inlet section.

14 Claims, 2 Drawing Sheets

Figure 1:
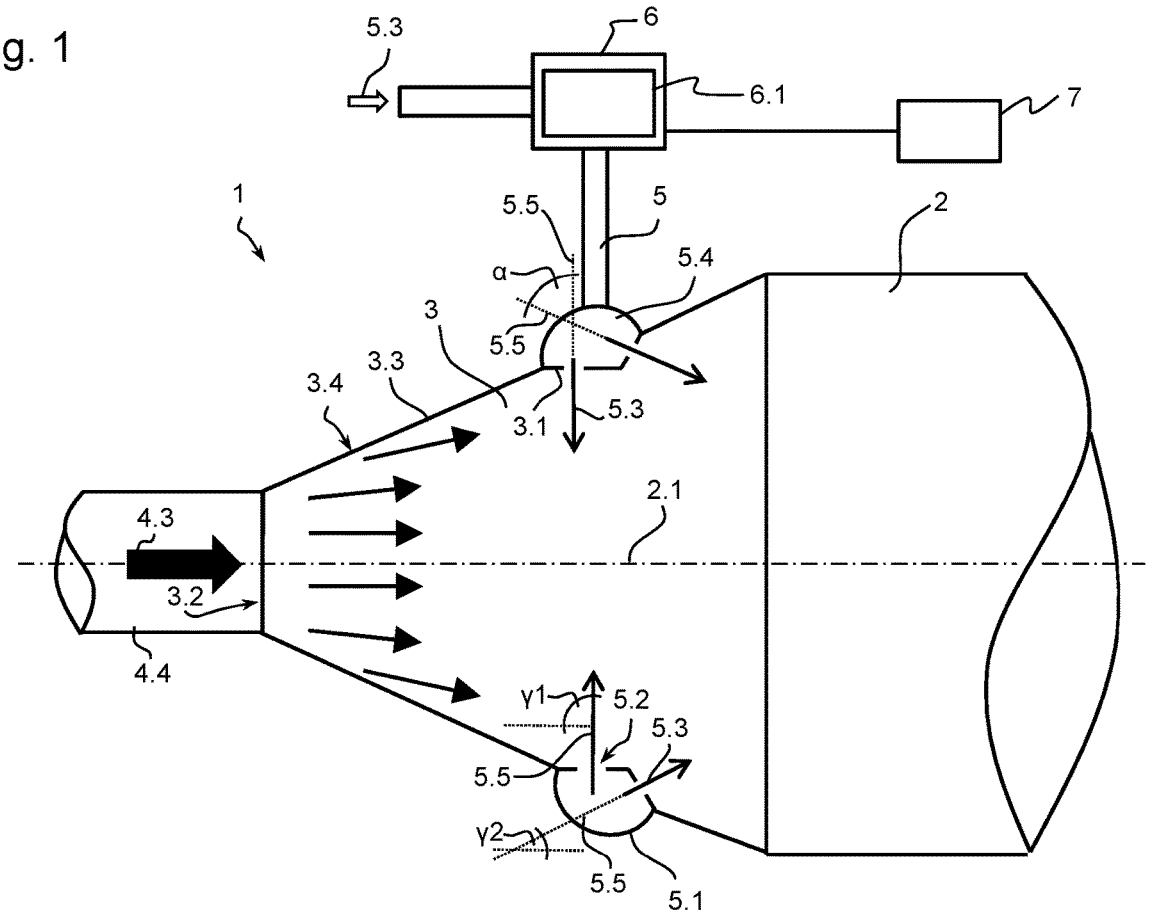

(51) Int. Cl.
*F01N 3/24* (2006.01)
*F01N 9/00* (2006.01)

(52) U.S. Cl.
CPC ..... *F01N 2230/04* (2013.01); *F01N 2270/00* (2013.01); *F01N 2470/00* (2013.01); *F01N 2470/02* (2013.01); *F01N 2470/04* (2013.01); *F01N 2470/08* (2013.01); *F01N 2610/06* (2013.01); *F01N 2610/10* (2013.01); *F01N 2610/14* (2013.01)

(58) Field of Classification Search
CPC ..... F01N 2270/00; F01N 2470/00; F01N 2470/02; F01N 2470/04; F01N 2470/08; F01N 2610/06; F01N 2610/10; F01N 2610/14; F01N 2230/04
See application file for complete search history.

(56) References Cited

U.S. PATENT DOCUMENTS

| | | | |
|---|---|---|---|
| 5,826,428 | A | 10/1998 | Blaschke |
| 8,240,137 | B2 | 8/2012 | Liu et al. |
| 8,464,516 | B2 | 6/2013 | Bell et al. |
| 8,726,640 | B2 | 5/2014 | Tilinski et al. |
| 8,991,157 | B2 | 3/2015 | Mastbergen et al. |
| 9,140,163 | B2 | 9/2015 | Loman |
| 10,174,567 | B2 | 1/2019 | Wase |
| 10,174,657 | B2 | 1/2019 | Lee et al. |
| 2011/0061374 | A1 | 3/2011 | Noritake |

FOREIGN PATENT DOCUMENTS

| | | | | |
|---|---|---|---|---|
| DE | 10345986 | A1 * | 4/2005 | ..... F01N 13/02 |
| EP | 1333169 | B1 | 11/2005 | |
| EP | 1722079 | B1 | 11/2012 | |
| EP | 2607641 | A1 | 6/2013 | |
| EP | 2687286 | A2 | 1/2014 | |
| EP | 3130775 | B1 | 11/2019 | |
| KR | 101512160 | B1 | 4/2015 | |
| WO | WO-2012099667 | A2 | 7/2012 | |
| WO | WO-2017111430 | A1 | 6/2017 | |
| WO | WO-2021007069 | A1 | 1/2021 | |

OTHER PUBLICATIONS

International Search Report (English and German) and Written Opinion of the ISA (German) issued in PCT/EP2022/070629, mailed Nov. 3, 2022; ISA/EP.

* cited by examiner

EXHAUST GAS SYSTEM UNIT

CROSS-REFERENCE TO RELATED APPLICATIONS

This application is a U.S. National Phase Application under 35 U.S.C. 371 of International Application No. PCT/EP2022/070629, filed on Jul. 22, 2022, which claims the benefit of German Patent Application No. 10 2021 119 169.6, filed on Jul. 23, 2021, The entire disclosure of the aforementioned German patent application is incorporated herein by reference.

FIELD

The disclosure relates to an exhaust gas sub-system for an internal combustion engine, comprising a catalytic converter housing with an inlet section and with an inlet opening for introducing an exhaust gas flow or main exhaust gas flow into the catalytic converter housing and comprising, for secondary gas, a feed line that is free of an exhaust gas flow, the feed line comprising an inflow element at its end by means of which the secondary gas is fed to the main exhaust gas flow the inflow element preferably being placed directly upstream of the catalytic converter or upstream of the catalytic converter housing, wherein a heating element for heating the secondary gas is provided in the feed line upstream of the inflow element. The exhaust gas sub-system is part of an exhaust system that extends from the manifold to the exhaust end pipe. The internal combustion engine may be part of a stationary engine or machine, of a motor vehicle or of a ship.

BACKGROUND

This section provides background information related to the present disclosure which is not necessarily prior art.

An exhaust gas purification system is already known from EP 1 333 169 B1. This document describes a supply device for ambient air, which can be supplied via a conduct and an annular pipe located in the housing upstream of a particulate filter.

From U.S. Pat. No. 8,991,157 B2, a burner with an external air supply is known for heating an exhaust gas flow for the purpose of regenerating a downstream particulate filter.

From U.S. Pat. No. 10,174,567 B2, a plasma burner with an external air supply is known for heating an exhaust gas flow for the purpose of supplying an SCR catalytic converter that is located downstream.

An exhaust system for a diesel engine is known from EP 1 333 169 B1 with a particulate filter and an upstream oxidation catalytic converter as well as a controllable secondary air supply device. The secondary air supply device has a perforated ring pipe which is positioned in an inlet section of the housing.

From DE 39 19 343 A1, an exhaust gas sub-system for an internal combustion engine is known, comprising a catalytic converter housing with an integral inlet section and with an inlet opening for introducing an exhaust gas flow. The inlet opening is part of a supply line for secondary gas, the supply line having a heating element for heating the secondary gas.

SUMMARY

This section provides a general summary of the disclosure, and is not a comprehensive disclosure of its full scope or all of its features.

The disclosure is based on the problem of designing and arranging an exhaust gas sub-system for an internal combustion engine such that an improved cold start and an optimum temperature control of the catalytic converter becomes possible.

According to the disclosure, the problem is solved in that the inflow element is assigned or correlated at least one inflow opening at or in the inlet section, via which the heated secondary gas can be fed to the exhaust gas flow, wherein the inflow element, together with the inlet section designed as an outer housing, delimits a collecting chamber from which the secondary gas can be guided or fed via the inflow opening into the exhaust gas carrying part of the inlet section, wherein each inflow opening comprises an opening cross-section and an opening axis. This ensures that externally heated gas, in particular ambient air used for preheating a catalytic converter, can be fed to the catalytic converter during a cold start of an internal combustion engine. Furthermore, the temperature of the catalytic converter can be controlled after the cold start during normal operation of the combustion engine. The heating element is separate from the combustion engine. It is not part of the combustion engine. Rather, it can be operated independently of the combustion engine. The heating element can be actively controlled and can therefore be switched on and off. It can also be controlled in such a way that the temperature of the secondary gas can be set to at least one or more predetermined temperatures. In this respect, the heating element can be regarded as external, as it is not part of the exhaust system, as the secondary gas and not the exhaust gas is flowing through it. The heated secondary gas is fed from the external heating element through the environment to the catalytic converter housing via the supply line. The heating element is part of a cold-start unit that supplies hot gas at a temperature that is to be predetermined to the exhaust gas flow, independently of the exhaust gas temperature of the combustion engine. The catalytic converter in the catalytic converter housing is positioned directly downstream of the inlet section in order to avoid heat losses. The heating element can be designed as a burner for generating hot gas or as an electric heating element for generating hot air. The hot gas must be distinguished from the exhaust gas flow of the combustion engine, which is hot or to be heated. The supply line and the heating element are arranged outside the exhaust gas-conducting elements of the exhaust gas sub-system and they conduct the exhaust gas from the heating element to the corresponding exhaust gas-conducting element of the exhaust gas sub-system or to the corresponding position of the inflow element. The inflow element can also be one or more feed nozzles.

The inflow element can be placed on or onto the inlet section. The collection chamber formed in this way is easily accessible from the outside. In addition, the flow paths for the engine exhaust gas inside of the inlet section are not strained or reduced by the inflow element. The respective opening axis is preferably aligned normal to the surface of the inlet section or normal to the surface of the recesses. An inclined alignment of the respective opening axis is also possible. In this respect, the collection chamber represents an inflow chamber and an outflow chamber for the secondary gas. If the inlet section is single-walled, the outer housing also comprises the outer side. If the inlet section is formed air-gap insulated, i.e. double-walled or integrated into another housing, the outer side is also the side of the inlet section facing away from the exhaust gas.

The problem is also solved by an exhaust system comprising an exhaust gas sub-system as defined above. The exhaust system additionally comprises at least one catalytic converter arranged in the catalytic converter housing and corresponding exhaust pipes positioned at its end for connecting the exhaust system thus formed to further components of an exhaust system.

The problem is also solved by a method for operating the aforementioned exhaust system, in which the secondary gas is heated by means of the heating element so that the temperature of a catalytic converter is regulated. The catalytic converter is heated to a temperature at which it operates efficiently. During a cold start, the catalytic converter can be heated to an operating temperature by means of the heating element. After the cold start during normal operation, the temperature of the catalytic converter can be regulated to a desired temperature at at least one additional point in time.

It can be advantageous if the inflow element is positioned at the inlet section and/or if the inflow opening is provided in the inlet section. This ensures that the heated secondary gas flows close to the catalytic converter.

Multiple inflow elements can also be provided at different positions upstream of the respective catalytic converter housing. The multiple inflow elements can be arranged axially or they can be distributed around the circumference of the respective exhaust gas-conducting elements of the exhaust gas sub-system.

Furthermore, it can be advantageous if all inflow openings comprise the same opening cross-section or if at least a first part of 30% to 70% of the inflow openings comprises a larger opening cross-section than a second part of 70% to 30% of the inflow openings. The inflow opening can be a hole or a recess, wherein, in particular, the hole can have a round or oval opening cross-section. The inflow openings can be free of vanes or guide elements. By varying the opening cross-sections, the flow paths of the hot air that arise during mixing or their distribution in the exhaust gas can be optimized. The multiple inflow openings form a perforation with a perforation pattern as further defined below by way of example.

It can also be advantageous if the inlet section comprises several recesses, with at least one inflow opening being provided in each recess. The inflow opening or openings preferably run in a circumferential direction U, i.e. circumferentially. The available collection space can be increased by forming recesses. Blockages of the holes due to deposits of soot or particles in the holes can impair the functionality of the holes and thus of the exhaust gas sub-system. The recesses prevent the holes from becoming blocked. It may be advantageous if opening axes of adjacent inlet openings and/or opening axes within a recess are inclined or set at an angle $\alpha$ to each other. By using an angle of attack/incidence, the flow paths of the hot air that arise during mixing or their distribution in the exhaust gas can be optimized. The resulting angular plane can be aligned radially to the main exhaust gas flow axis. The angle $\alpha$, wherein $\alpha>0$, can depend on the cross-sectional shape of the recess. In this sense, the inlet openings are free of guide elements.

It can be of particular importance for the present disclosure if the angle $\alpha$ fulfills the following condition: $20° <= \alpha <= 1700$ or $70° <= \alpha <= 90°$. Depending on the existing flow conditions or the load conditions being in focus in the exhaust gas flow, an optimum inflow of hot air can be ensured with such an angle range. In this respect, the secondary gas is mixed particularly well with the exhaust gas flow.

In connection with the design and arrangement according to the disclosure, it can be advantageous if opening axes of adjacent inflow openings and/or opening axes within a recess are inclined or set at different angles $\gamma1$, $\gamma2$ towards an exhaust gas main flow center axis, wherein $70° <= \gamma1 <= 90°$ and $20° <= \gamma2 <= 40°$. With such an angle range, an optimum inflow of hot air can be ensured depending on the existing flow conditions or the load conditions being in focus in the exhaust gas flow. This optimizes the mixing of the secondary gas with the exhaust gas flow. The exhaust gas main flow center axis corresponds to a center axis of the catalytic converter housing element or to a center axis of the inlet element. The orientation of the hot gas flow to be mixed in can also have a directional component that can be directed against the exhaust gas flow.

It can also be advantageous if at least two rows of inflow openings and/or two rows of recesses are provided, with at least one inflow opening per recess, respectively, wherein the rows run in the circumferential direction U with reference to the main exhaust gas flow axis and are arranged next to each other. This allows hot gas to be introduced in at least two stages via the first row and the at least second row. The fact that at least a first part of 30% to 70% of the inflow openings has a larger opening cross-section than the other part of the inflow openings also applies in relation to the rows. Inlet openings of a row or inlet openings of different rows or of neighboring rows can therefore have a different opening cross-section. This measure also improves the mixing of the secondary gas and the exhaust gas flow.

It can also be advantageous if, within at least one row, the angle $\alpha$ varies between two inlet openings or the angle $\gamma1$ or the angle $\gamma2$ varies. The angle $\alpha$ between two inflow openings and/or the angle $\gamma1$, $\gamma2$ within a row can also be the same.

It can also be advantageous if, between adjacent rows, the angle $\alpha$ varies and/or the angle $\gamma1$, $\gamma2$ varies. The angle $\alpha$ between two inflow openings and/or the angle $\gamma1$, $\gamma2$ of adjacent rows can also be the same.

It can be advantageous if the inflow element encloses the inlet section with respect to the circumferential direction U of the main exhaust gas flow axis at an angle $\beta$, wherein $50° <= \beta <= 360°$. The enclosure angle $\beta$ should not be less than a minimum value in order to enable a regular or uniform inflow of hot gas. The angle $\beta$ therefore also limits the circumferential extent of the respective row of openings or recesses or of the recess.

It can also be advantageous if the heating element heats the secondary gas electrically or by means of a combustion chamber or combustor of the heating element. Electrical heating converts electrical energy into thermal energy. In this way, the secondary gas is heated. A fuel is burned inside the combustion chamber. This generates heat, which is used to heat the secondary gas. Both methods are efficient and allow the heating element to be operated actively, separately and externally.

It can also be advantageous if a control unit is provided for actively controlling the heating element in order to adjust the temperature and/or the mass flow of the heated secondary gas. This allows the heating element to be actively controlled or regulated.

Further areas of applicability will become apparent from the description provided herein. The description and specific examples in this summary are intended for purposes of illustration only and are not intended to limit the scope of the pre-sent disclosure.

DRAWINGS

The drawings described herein are for illustrative purposes only of selected embodiments and not all possible implementations, and are not intended to limit the scope of the present disclosure.

Figure 2A:
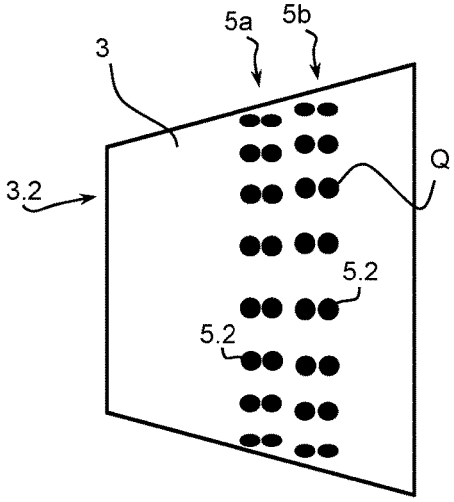
Figure 2B:
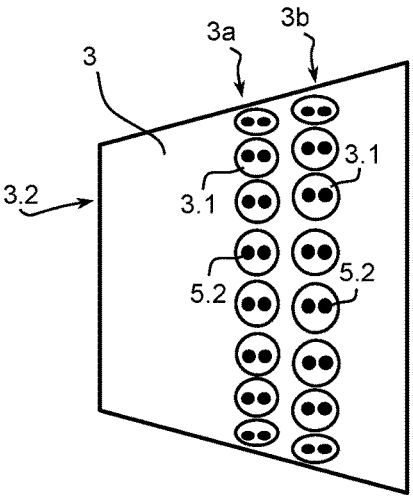

Further advantages and details of the disclosure are explained in the claims and in the description and shown in the figures. It shows:

FIG. 1 a schematic representation of the exhaust gas sub-system;

FIG. 2*a* a schematic representation of the inlet section with inflow openings;

FIG. 2*b* a further embodiment with respect to FIG. 2*a;*

Figure 3:
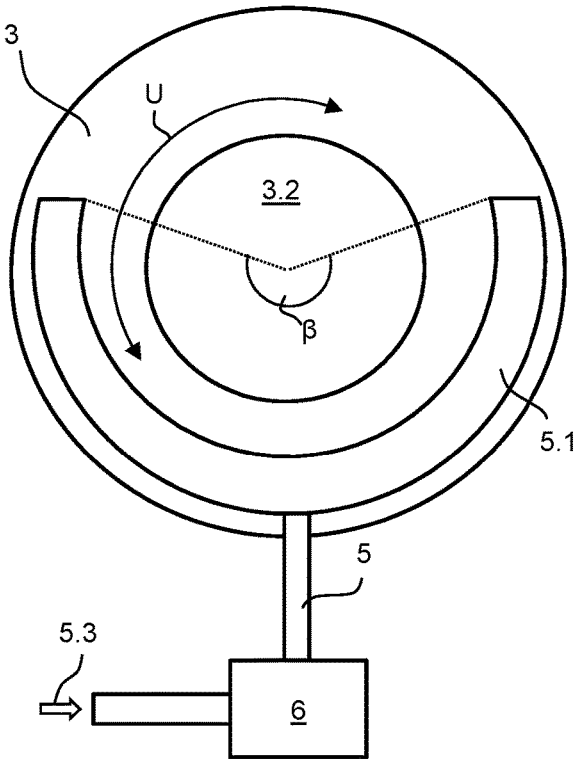
Figure 4:
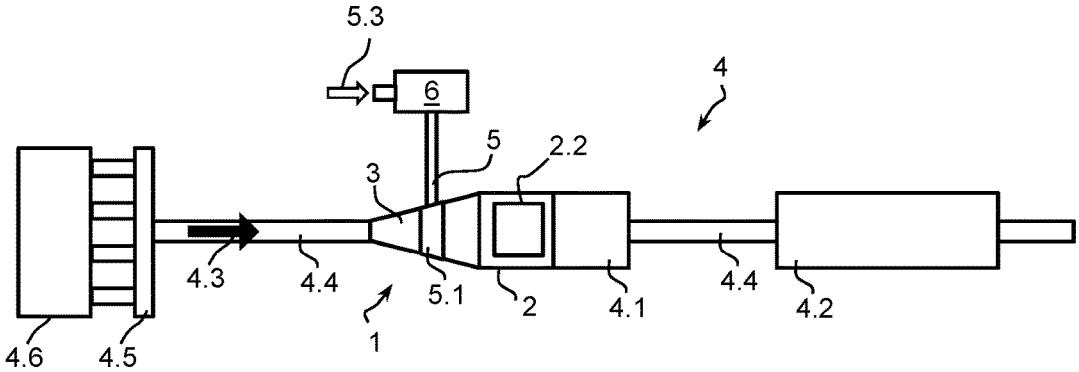

FIG. 3 a schematic sketch of the inlet section as seen from the front;

FIG. 4 a schematic sketch of a motor vehicle exhaust system.

Corresponding reference numerals indicate corresponding parts throughout the several views of the drawings.

DETAILED DESCRIPTION

Example embodiments will now be described more fully with reference to the accompanying drawings.

An exhaust gas sub-system 1 shown in FIG. 1 is part of a comprehensive exhaust gas system 4 according to FIG. 4 for complete cleaning and aftertreatment of an exhaust gas flow 4.3 or of a main exhaust gas flow of an internal combustion engine 4.6. Downstream of the exhaust gas sub-system 1 described further below, the exhaust gas system 4 comprises a catalytic converter housing 2 with an exhaust gas catalytic converter not shown in further detail and a particulate filter 4.1 and, further downstream, an exhaust gas silencer 4.2. The exhaust gas sub-system 1 is connected to a manifold 4.5 of the combustion engine 4.6. The respective components are flow-coupled to each other via exhaust pipes 4.4.

The exhaust gas sub-system 1 comprises an exhaust gas-carrying inlet section 3, which is coupled upstream to the catalytic converter housing 2 for the purpose of supplying exhaust gas. Opposite the catalytic converter housing 2, the inlet section 3 is fed with the exhaust gas flow 4.3 of the combustion engine 4.6 via an exhaust pipe that is not shown in further detail. The exhaust gas entering upstream of the inlet section 3 is routed to the catalytic converter housing 2 via the inlet section 3. The inlet section 3 comprises a conical basic shape so that its flow cross-section increases from an inlet opening 3.2 to the catalytic converter housing 2.

The inlet section 3 is coupled to an inflow element 5.1, which according to FIG. 1 is designed as a half-shell channel, which is placed on an outer side 3.4 of the inlet section 3 in the circumferential direction U, as shown in FIG. 3. Together with the inlet section 3 or the outer side 3.4 of its housing wall 3.3, the inflow element 5.1 forms a collection chamber 5.4, which is supplied with heated secondary gas 5.3 via a supply line 5 and a heating element connected thereto at an upstream position. The heated secondary gas 5.3 flows into the inlet section 3 via the collection chamber 5.4 and corresponding inflow openings 5.2 within the inlet section 3 or within a housing wall 3.3 of the inlet section 3 and is mixed there with the exhaust gas flow 4.3 or is mixed into the exhaust gas flow 4.3. The housing wall 3.3 comprises several inlet openings 5.2. According to FIG. 2*a*, the inlet openings 5.2 are each arranged as a hole and distributed in the circumference of the inlet section 3 or in the circumferential direction U. The opening cross-section Q is round. Alternatively, it can be oval. Since no flow guide elements are provided at the inlet openings 5.2, the opening cross-section Q is free of guide elements. According to FIG. 2*a*, two rows 5*a*, 5*b* of inflow openings 5.2 are provided. According to the embodiment of FIG. 2*b*, two rows 3*a*, 3*b* of recesses 3.1 are provided, with two inflow openings 5.2 each being arranged within a recess 3.1 of the housing wall 3.3.

In the sectional view according to the embodiment of FIG. 1, the respective recess 3.1 is shown with the two inflow openings 5.2 contained therein.

The respective inflow opening 5.2 comprises an opening axis 5.5 that is aligned normal to the surrounding housing wall 3.3. According to the embodiment of FIG. 1, two inflow openings 5.2 are provided in the respective recess 3.1 whose opening axis 5.5 is set or inclined at an angle $\alpha$ to each other. According to the embodiment of FIG. 1, lower half, a first flow axis is radially aligned and forms an angle $\gamma 1$ of approximately 90° with an exhaust gas main flow axis 2.1. The other opening axis forms an angle $\gamma 2$ of approximately 30° with the main exhaust gas flow axis 2.1. This means that a part of the hot gas is supplied in a radial direction and another part of the exhaust gas is supplied with a corresponding axial directional component. The angle $\gamma 1$ can also be less than 90°. This would be accompanied by a directional component that is directed into the opposite direction of the main exhaust gas direction.

The collection chamber 5.4 is supplied via a feed line from an active, separate and external heating element 6 comprising a combustion chamber or combustor 6.1, into which secondary gas 5.3 flows for the purpose of heating and which, when heated, is released to the collection chamber 5.4, and thus to and into the inlet section 3. Alternatively, the secondary gas 5.3 can be heated electrically. Moreover, a control unit 7 is provided, which regulates the active heating element 6 and adjusts the temperature and mass flow of the secondary gas 5.3.

In the embodiment of FIG. 3, the inlet section 3 is shown in a front view. The inflow element 5.1 extends over an angle $\beta$ having approximately 200°. The inflow element 5.1 is also supplied via a supply line 5 with a secondary gas 5.3 that was heated in the heating element 6, in this case with ambient air.

According to FIG. 4, the exhaust system 4 of a motor vehicle comprises an internal combustion engine 4.6 comprising a manifold 4.5. The exhaust gas flow 4.3 is directed through the exhaust pipe 4.4 and fed to the inlet section 3. The inflow element 5.1 is provided at the inlet section 3, through which the secondary gas 5.3, heated by the heating element 6, is fed into the exhaust gas flow 3 and mixed with the exhaust gas flow 3. In particular, the heating element 6 is not part of the exhaust system 4 and is therefore to be regarded as external. Further downstream, there is provided a catalytic converter housing 2 with a catalytic converter 2.2, to which a particulate filter 4.1 is connected. An exhaust silencer 4.2 is provided at the end of the exhaust pipe 4.4.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are to be regarded as a departure from the disclosure, and all such modifications are intended to be included within the scope of the disclosure.

The invention claimed is:

1. An exhaust gas sub-system for an internal combustion engine, comprising:

a catalytic converter housing with an inlet section and with an inlet opening for introducing an exhaust gas flow into the catalytic converter housing and, for secondary gas, a feed line that is free of the exhaust gas flow, the feed line comprising an inflow element at its end, by means of which the secondary gas is fed to the exhaust gas flow, wherein the inflow element is placed upstream of the catalytic converter housing, wherein a heating element for heating the secondary gas is provided in the feed line upstream of the inflow element, wherein at least one inflow opening at the inlet section is correlated to the inflow element via which the heated secondary gas can be fed to the exhaust gas flow starting from the feed line, wherein the inflow element together with an outer side of the inlet section delimits a collection chamber from which the secondary gas can be guided into the inlet section via the at least one inflow opening, wherein each of the inflow openings comprises an opening cross-section and an opening axis, wherein the opening axes of adjacent inflow openings are inclined at an angle $\alpha$ to one another and thereby comprising different incident angles towards an exhaust gas main flow center axis.

2. The exhaust gas sub-system according to claim 1, wherein all inflow openings comprise the same opening cross-section, or that at least a first part of 30% to 70% of the inflow openings comprise a larger opening cross-section than a second part of 70% to 30% of the inflow openings.

3. The exhaust gas sub-system according to claim 1, wherein the inlet section comprises at least one or more recesses, at least one of the inflow openings being provided in each of the recesses.

4. The exhaust gas sub-system according to claim 2, wherein the opening axes are inclined at the angle $\alpha$ to one another within a recess.

5. The exhaust gas sub-system according to claim 4, wherein the angle $\alpha$ fulfils the following condition: $20° <= \alpha <= 170°$ or $70° <= \alpha <= 90°$.

6. The exhaust gas sub-system according to claim 2, wherein the opening axes of the adjacent inflow openings and/or the opening axes within a recess are inclined at different angles $\gamma 1$, $\gamma 2$ towards an exhaust gas main flow center axis, wherein $70° <= \gamma 1 <= 90°$ and $20° <= \gamma 2 <= 40°$.

7. The exhaust gas sub-system according to claim 1, wherein at least two rows of the inflow openings and/or two rows of recesses are provided, each comprising at least one of the inflow openings per recess, the rows extending in a circumferential direction U with respect to the exhaust gas main flow center axis and being arranged next to one another.

8. The exhaust gas sub-system according to claim 7, wherein within at least one of the rows, the angle $\alpha$ varies between the two inflow openings and/or an angle $\gamma 1$, $\gamma 2$ varies.

9. The exhaust gas sub-system according to claim 7, wherein between adjacent rows, the angle $\alpha$ varies and/or an angle $\gamma 1$, $\gamma 2$ varies.

10. The exhaust gas sub-system according to claim 1, wherein the inflow element encloses the inlet section with respect to a circumferential direction U of the exhaust gas main flow center axis at an angle $\beta$, wherein $50° <= \beta <= 360°$.

11. The exhaust gas sub-system according to claim 1, wherein that the secondary gas can be heated electrically via the heating element or by means of a combustor of the heating element.

12. The exhaust gas sub-system according to claim 1, wherein a control unit is provided for actively controlling the heating element, by means of which a temperature and/or a mass flow of the secondary gas can be adjusted.

13. The exhaust gas system comprising an exhaust sub-system according to claim 1.

14. A method for operating an exhaust gas system according to claim 13, comprising heating the secondary gas by means of the heating element so that the temperature of a catalytic converter is regulated.

* * * * *